US009938041B2

(12) United States Patent
Belko et al.

(10) Patent No.: US 9,938,041 B2
(45) Date of Patent: Apr. 10, 2018

(54) COMBINED BOX AND RESEALABLE BAG

(75) Inventors: Stephen P. Belko, Blackwood, NJ (US); Neil J. Kozarsky, Mount Laurel, NJ (US); Eliot M. Kozarsky, Moorestown, NJ (US)

(73) Assignee: ZIPBOX LICENSE, LLC., Marlton, NJ (US)

( * ) Notice: Subject to any disclaimer, the term of this patent is extended or adjusted under 35 U.S.C. 154(b) by 993 days.

(21) Appl. No.: 12/460,682

(22) Filed: Jul. 23, 2009

(65) Prior Publication Data

US 2011/0017814 A1 Jan. 27, 2011

(51) Int. Cl.
*B31B 1/60* (2006.01)
*B65D 5/56* (2006.01)
(Continued)

(52) U.S. Cl.
CPC ..... *B65D 5/563* (2013.01); *B65B 1/02* (2013.01); *B65D 5/606* (2013.01); *B65D 31/06* (2013.01);
(Continued)

(58) Field of Classification Search
CPC ..... B31B 17/00; B31B 2217/082; B31B 1/60; B31B 2201/60; B31B 1/84; B31B 2201/9085; B31B 7/00; B31B 3/00; B31B 2105/00; B31B 50/0044; B31B 2120/408; B31B 2120/30; B31B 50/64;
(Continued)

(56) References Cited

U.S. PATENT DOCUMENTS 3,233,817 A * 2/1966 Casady ..... 229/117.3
3,611,883 A * 10/1971 Grob ..... 493/221
(Continued)

FOREIGN PATENT DOCUMENTS

CN 1398764 2/2003
CN 101087719 12/2007
(Continued)

OTHER PUBLICATIONS

PCT/US2010/042282, International Search Report and Written Opinion of the International Searching Authority, dated Feb. 28, 2011.

(Continued)

*Primary Examiner* — Sameh Tawfik
(74) *Attorney, Agent, or Firm* — Cozen O'Connor

(57) ABSTRACT

A combined box and resealable bag includes a paperboard box having a front wall, a rear wall, a pair of opposed side walls and a plurality of flaps capable of forming a bottom wall. The box walls have upper ends and lower ends, inside surfaces and outside surfaces. The upper end of each of the box walls is folded outwardly and downwardly so that the inside surface of each of the upper ends forms a strip that faces outwardly. The inside surfaces of the box walls, including the outwardly facing strips, have a thermal plastic coating thereon. The combination also includes a bag made of flexible plastic material having a zippered top and downwardly extending front and rear bag walls. While the box is still in its flat blank condition, the lower edge portion of the bag walls are heat sealed to the outwardly facing strips on the box blank. Thereafter, the front, rear and side walls of the box blank are expanded to form a box.

12 Claims, 6 Drawing Sheets

(51) Int. Cl.

| | |
|---|---|
| ***B65D 5/60*** | (2006.01) |
| ***B65D 30/16*** | (2006.01) |
| ***B65D 33/25*** | (2006.01) |
| ***B65D 75/58*** | (2006.01) |
| ***B65B 1/02*** | (2006.01) |
| *B65B 61/18* | (2006.01) |
| *B31B 50/64* | (2017.01) |
| *B31B 120/30* | (2017.01) |
| *B31B 105/00* | (2017.01) |
| *B31B 50/00* | (2017.01) |
| *B31B 50/81* | (2017.01) |
| *B31B 120/40* | (2017.01) |

(52) U.S. Cl.
CPC ..... *B65D 33/2508* (2013.01); *B65D 75/58* (2013.01); *B31B 50/0044* (2017.08); *B31B 50/64* (2017.08); *B31B 50/8144* (2017.08); *B31B 2105/00* (2017.08); *B31B 2120/30* (2017.08); *B31B 2120/408* (2017.08); *B65B 61/188* (2013.01); *Y10T 156/10* (2015.01)

(58) Field of Classification Search
CPC ..... B65B 61/188; B65B 1/02; B65D 5/563; B65D 5/606; B65D 31/06; B65D 33/2508; B65D 75/58
USPC ..... 493/84, 87, 93, 102, 114, 121, 131, 133, 493/150, 213
See application file for complete search history.

(56) References Cited

U.S. PATENT DOCUMENTS

| | | | | |
|---|---|---|---|---|
| 3,878,771 | A * | 4/1975 | Malcolm | 493/67 |
| 3,902,652 | A * | 9/1975 | Malcolm | 222/81 |
| 4,226,170 | A | 10/1980 | Christensson | |
| 4,691,373 | A | 9/1987 | Ausnit | |
| 4,779,998 | A | 10/1988 | Wischusen, III | |
| 4,815,631 | A * | 3/1989 | Eeg et al. | 229/117.3 |
| 5,211,482 | A * | 5/1993 | Tilman | 383/202 |
| 5,249,685 | A * | 10/1993 | Stephens | 206/523 |
| 5,461,845 | A | 10/1995 | Yeager | |
| 5,553,708 | A * | 9/1996 | Lawrence et al. | 206/419 |
| 5,749,658 | A | 5/1998 | Kettner | |
| 5,755,962 | A | 5/1998 | Gershenson et al. | |
| 5,788,378 | A * | 8/1998 | Thomas | 383/63 |
| 5,827,163 | A | 10/1998 | Kettner | |
| 6,082,897 | A * | 7/2000 | Galomb | 383/63 |
| 6,186,663 | B1 | 2/2001 | Ausnit | |
| 6,585,153 | B2 * | 7/2003 | Ryan | 229/117.32 |
| 6,908,422 | B2 | 6/2005 | Ichikawa et al. | |
| 6,986,729 | B2 | 1/2006 | Ichikawa et al. | |
| 7,066,869 | B2 * | 6/2006 | Cook et al. | 493/69 |
| 7,160,029 | B2 | 1/2007 | Bein et al. | |
| 7,350,670 | B2 * | 4/2008 | Steeves et al. | 222/105 |
| 7,624,873 | B2 * | 12/2009 | Tennant et al. | 206/569 |
| 8,220,651 | B2 | 7/2012 | Norcom | |
| 2003/0183650 | A1 | 10/2003 | Muise et al. | |
| 2005/0194386 | A1 | 9/2005 | Shai | |
| 2006/0137997 | A1 | 6/2006 | Bein et al. | |
| 2006/0193541 | A1 | 8/2006 | Norcom | |

FOREIGN PATENT DOCUMENTS

| | | |
|---|---|---|
| CN | 101119899 | 2/2008 |
| EP | 1775229 | 4/2007 |
| FR | 1 182 724 | 6/1959 |
| JP | 42-10718 | 6/1942 |
| JP | 42-10718 | 6/1967 |
| JP | 02-016748 | 1/1990 |
| JP | 06-18909 | 5/1994 |
| JP | 2003-034338 | 2/2003 |
| JP | 2003-341651 | 12/2003 |
| JP | 2005-104483 | 4/2005 |
| JP | 2007-069944 | 3/2007 |
| JP | 2007-076698 | 3/2007 |
| JP | 2008-529908 | 8/2008 |
| JP | 2009035317 | 2/2009 |

OTHER PUBLICATIONS

Office Action dated May 10, 2017 which issued in the corresponding Korean Patent Application No. 10-2017-7001324.
Office Action dated Jul. 19, 2017 which issued in the corresponding Chinese Patent Application No. 201410647378.0.
Office Action dated Mar. 9, 2016 which issued in the corresponding Japanese Patent Application No. 2012-521695.

* cited by examiner

COMBINED BOX AND RESEALABLE BAG

BACKGROUND OF THE INVENTION

The present invention is directed toward a combined box and resealable bag and more particularly, toward a method for producing a combined box and resealable bag wherein the bag is secured to the outer surface of the box during manufacture.

Foodstuffs such as cereals and the like and numerous other products have been sold in paperboard boxes for many years. Such packaging is desirable since the packages protect the product and stack easily for shipping and for display on shelves for sale and for storage. In order to protect the product from spoilage, the box normally will have a plastic bag or the like in the interior thereof which contains the product. After the box and bag have been opened and the desired amount of product has been removed, the bag is closed, usually by folding the top thereof over upon itself, in order to reseal the same. Such inner bags, however, are frequently difficult to open and almost never reseal effectively.

More recently, products have been proposed wherein the bag is essentially outside of the box rather than inside the same. U.S. Pat. No. 6,908,422, for example, shows a paperboard box inserted into a plastic bag which has a recloseable zippered top. The box is inserted while in its collapsed form and must be manipulated into an open position when it is desired to fill the same. This can create a problem since the entire box is within the bag and it can be difficult to open the box without damaging the bag.

Published U.S. Patent Application No. U.S. 2005/0194386 is directed toward a zipper box cover for resealing paperboard boxes of food products such as cereals or the like. The invention shown in this application is an after market product that resembles a zippered plastic bag at the top but which has an open bottom with an elastic strip around the bottom edge. The bag is intended to fit over the top of an opened box and held in place by the elastic. It does not appear, however, that an effective seal is formed. Furthermore, the consumer must purchase the covers separately.

A similar arrangement is shown in U.S. Pat. No. 7,160,029 and particularly in the embodiment shown in FIG. 9b thereof. However, instead of elastic at the bottom of the bag, the lower edge includes a strip of adhesive. While this may create a better seal in some instances, this occurs only if the bottom of the bag is essentially the same dimensions as the box. Furthermore, as with the bag with the elastic trip, the consumer must purchase these covers separately and must purchase a variety of different size covers.

There is, therefore, a need for a combined box and bag that is capable of effectively resealing the box after it has been opened in order to preserve the freshness of the product therein and which is easily manufactured and convenient for the consumer to use.

SUMMARY OF THE INVENTION

The present invention is designed to overcome the deficiencies of the prior art discussed above. It is an object of the present invention to provide a combined box and resealable bag.

It is another object of the present invention to provide a combined box and resealable bag wherein the bag is secured to the outer surface of the box during manufacture thereof.

It is a further object of the present invention to provide a combined box and resealable bag that is easy and inexpensive to manufacture utilizing known automated equipment.

It is a still further object of the present invention to provide a combined box and resealable bag that is capable of holding significantly more product than conventional packaging resulting in fewer pallets, fewer trucks and less energy consumption and pollution.

In accordance with the illustrative embodiments, demonstrating features and advantages of the present invention, there is provided a combined box and resealable bag that includes a paperboard box having a front wall, a rear wall, a pair of opposed side walls and a plurality of flaps capable of forming a bottom wall. The box walls have upper ends and lower ends, inside surfaces and outside surfaces. The upper end of each of the box walls is folded outwardly and downwardly so that the inside surface of each of the upper ends forms a strip that faces outwardly. The inside surfaces of the box walls, including the outwardly facing strips, have a thermal plastic coating thereon. The combination also includes a bag made of flexible plastic material having a zippered top and downwardly extending front and rear bag walls. While the box is still in its flat blank condition, the lower edge portion of the bag walls are heat sealed to the outwardly facing strips on the box blank. Thereafter the front, rear and side walls of the box blank are expanded to form a box.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
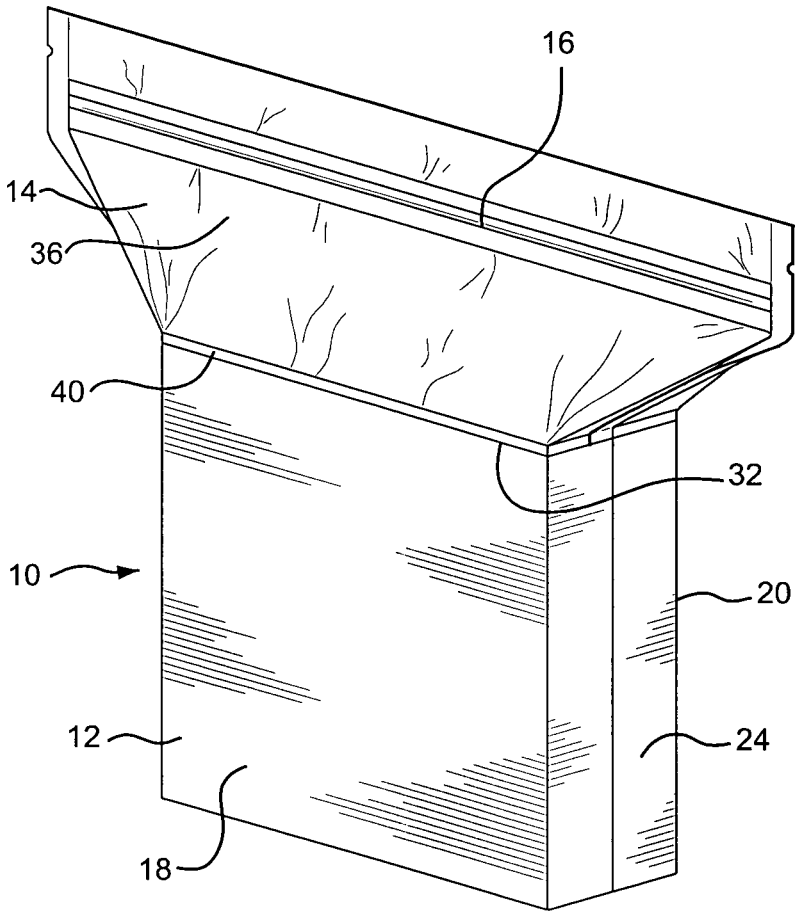
FIG. 1 is a front perspective view of the combined box and resealable bag of the present invention in its fully assembled form.

Referring now to the drawings in detail wherein like reference numerals have been used throughout the various figures to designate like elements, there is shown in FIG. 1 a combined box and resealable bag constructed in accordance with the principles of the present invention and designated generally as 10.

The combined box and resealable bag 10 of the present invention essentially includes a paperboard box 12 and a bag 14 made of a flexible plastic film material having a zippered top 16 secured to the top of the box 12. Except as more fully explained below, the paperboard box 12 and the bag 14 along with the zipper 16 are essentially of conventional construction. Accordingly, the details of the manner in which these component parts are produced are not believed to be necessary. The improvement of the present invention is in the combination of these parts and the specific manner in which they are combined.

Figure 2:
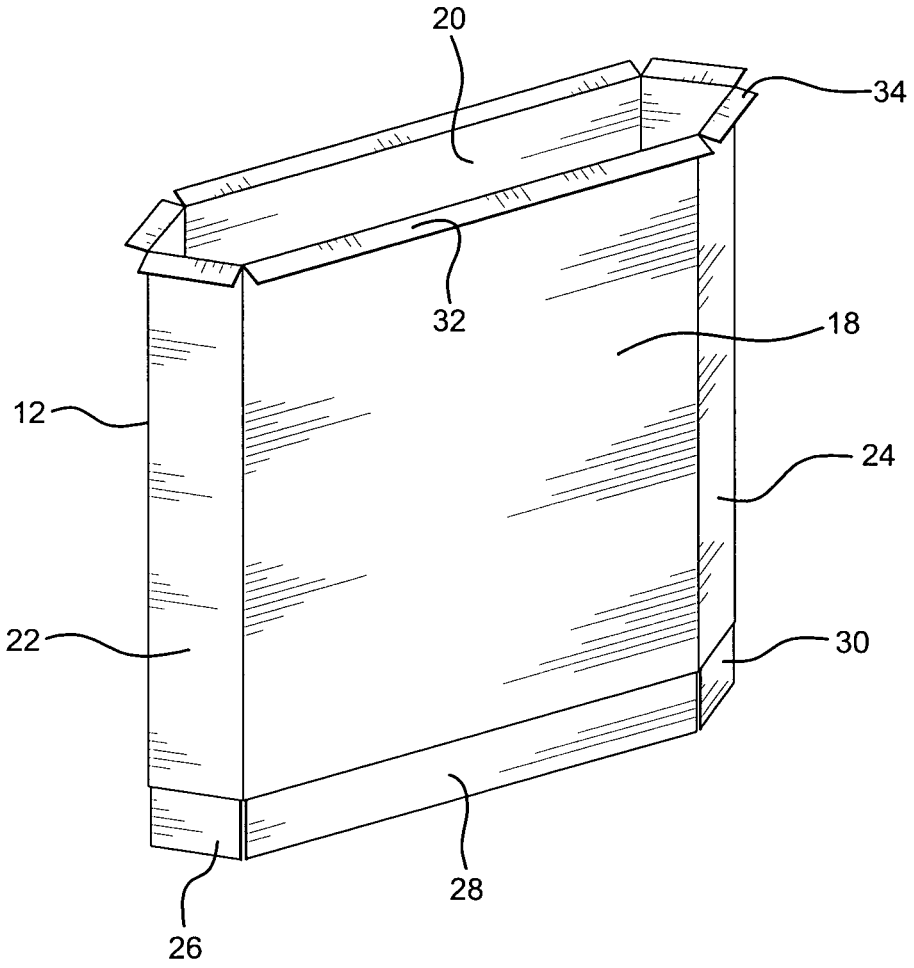
FIG. 2 is a perspective view illustrating how the top of the box is prepared for being attached to a bag.

As shown most clearly in FIG. 2, the box 12 includes a front wall 18, a rear wall 20, a pair of opposed side walls 22 and 24 and a plurality of flaps at the bottom, such as shown at 26, 28 and 30, that are capable of being folded inwardly to form a bottom wall. The top of the box 12 is open. That is, it does not include closing flaps such as shown at the bottom of the box. However, and as shown in FIG. 2, in the preferred embodiment of the invention, the upper end of each of the front, rear and side walls is folded outwardly and downwardly to form strips such as shown, for example, at 32 and 34. These strips may be approximately one quarter to one half inch and are folded back and glued or otherwise affixed to the outer surfaces of its respective wall.

In the preferred embodiment, the box 12 is constructed of thin cardboard or paperboard or the like. However, for larger or heavier applications, corrugated board may be used. For convenience, the term paperboard, as used herein, is intended to refer to conventional paperboard as well as cardboard and corrugated board.

In order to protect the product that will eventually be contained within the box, however, the inside surfaces of all of the box walls are coated with a thermoplastic material. This includes the strips such as 32 and 34. Accordingly, when the strips 32 and 34 (and the remaining strips) are folded over and secured to the outer walls as explained above, the outer exposed surface of the strips will also have the thermoplastic coating thereon and will lie in substantially the same plane as the outer surface of the walls.

Figure 3:
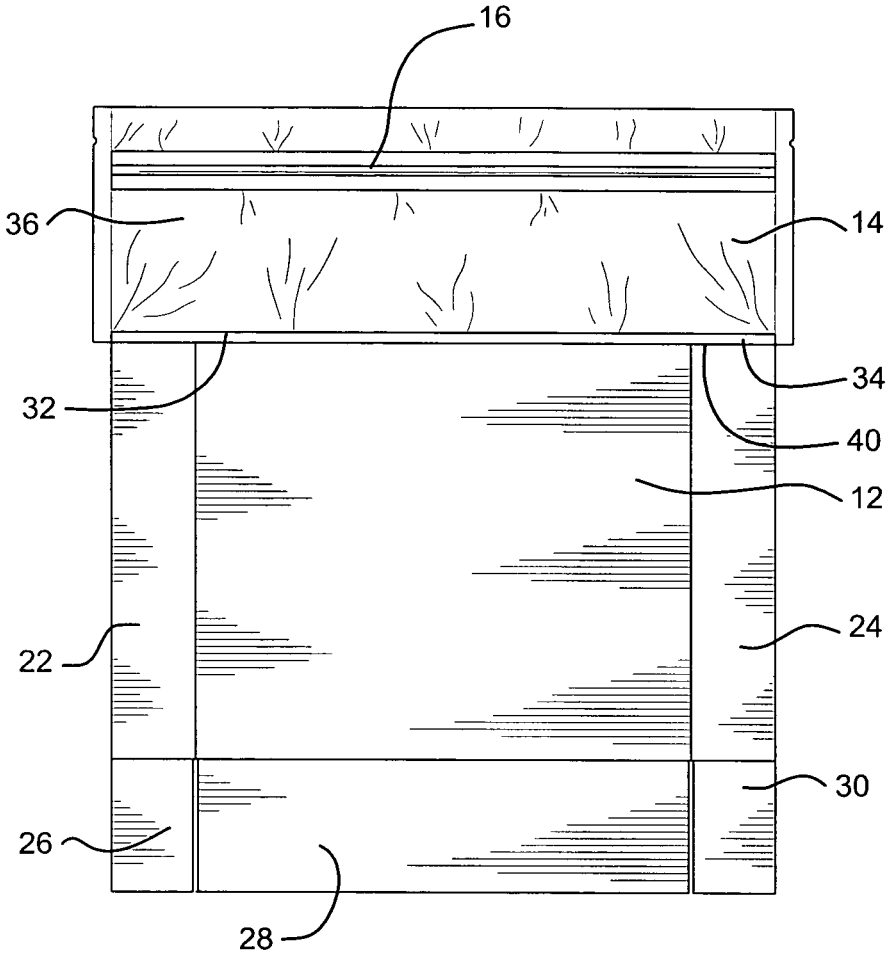
FIG. 3 is a front elevational view of the combined box and resealable bag showing the bag being attached to the top of the box blank while the blank is in a flat planar state before it is expanded into a box.

The bag 14, as indicated above, is of essentially standard construction as is the zipper 16. However, there is no bottom wall to the bag 14. The bag 14 does include a front wall 36 and a rear wall 38 that extend downwardly from the upper zipper portion 16. The front wall 36 of the bag 14 includes a lower edge portion 40. Similarly, the rear wall 38 includes a lower edge portion 42. The bag 14 is secured to the box 12 by heat sealing the lower edge portions 40 and 42 of the bag 14 to the outwardly facing strips 32 and 34 (and the remaining outwardly facing strips) while the box is in its flat position. That is, the bag is attached to the box while the box is still in what is commonly referred to as a box blank form before it is opened or expanded to form a box. This is, perhaps, best illustrated in FIG. 3.

Figure 5:
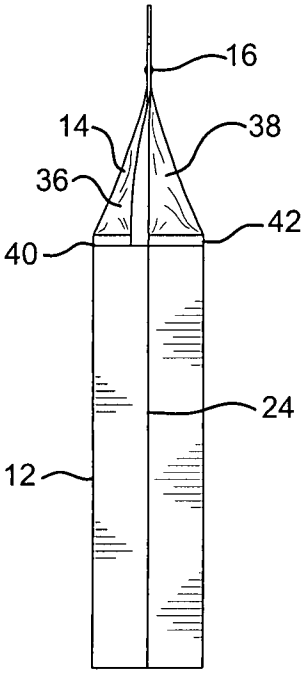
FIG. 5 is a side elevational view of the combined box and resealable bag of FIG. 4, and FIGS. 6 and 7 are schematic representations showing one example of how the combined box and resealable bag of the invention can be produced.
Figure 4:
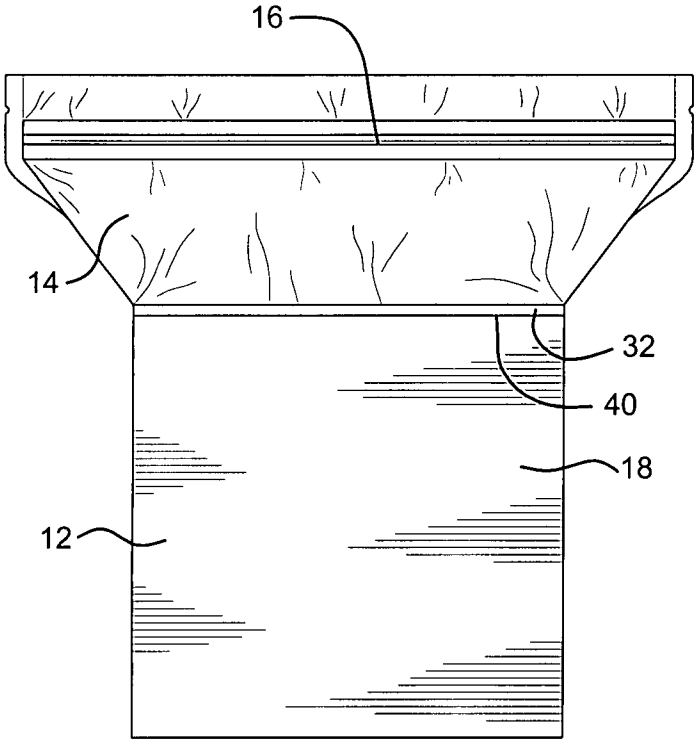
FIG. 4 is a front elevational view of the combined box and resealable bag showing the bag attached to the top of the box and with the box in its expanded condition.

After the bottom edges 40 and 42 of the bag 14 are heat sealed to the strips 32 and 34 at the top of the box, the box blank can then be opened or expanded to form the box as shown in FIGS. 1, 4 and 5. The bottom flaps 26, 28 and 30 are assembled and secured together in a known manner. The zippered top 16 of the bag 14 can then be opened and the bag filled, as desired. Thereafter, the bag can be resealed closed.

In some applications, it may be desirable to also coat the outside of the box with a thermoplastic coating. This will not only provide additional protection for the product contained within the box but will allow the bag to be heat sealed to the box without turning down the upper edges of the box to form the strips. As a result, the bag can be provided with longer front and rear walls and can be sealed to the box near or at the bottom thereof.

Figure 6:
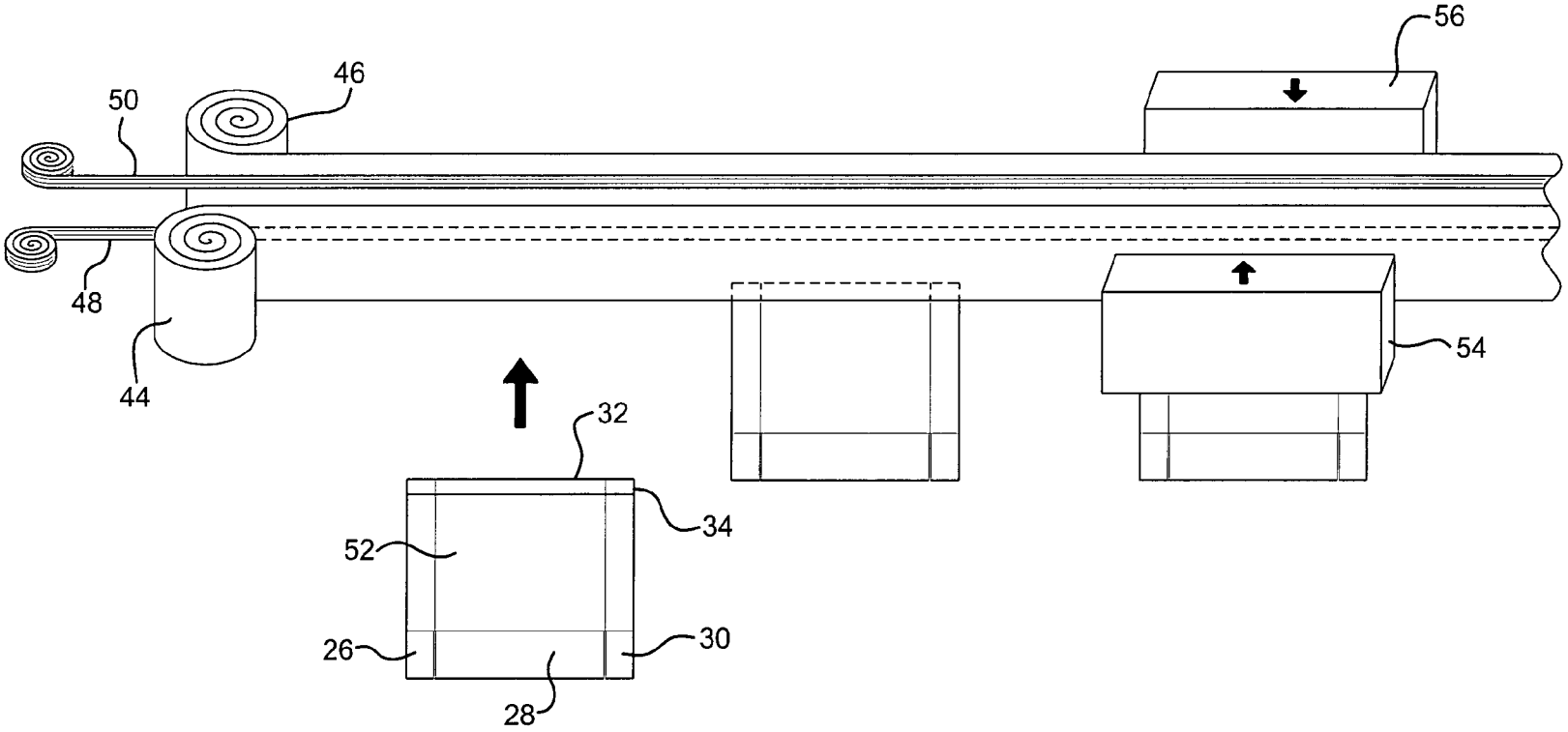
Figure 7:
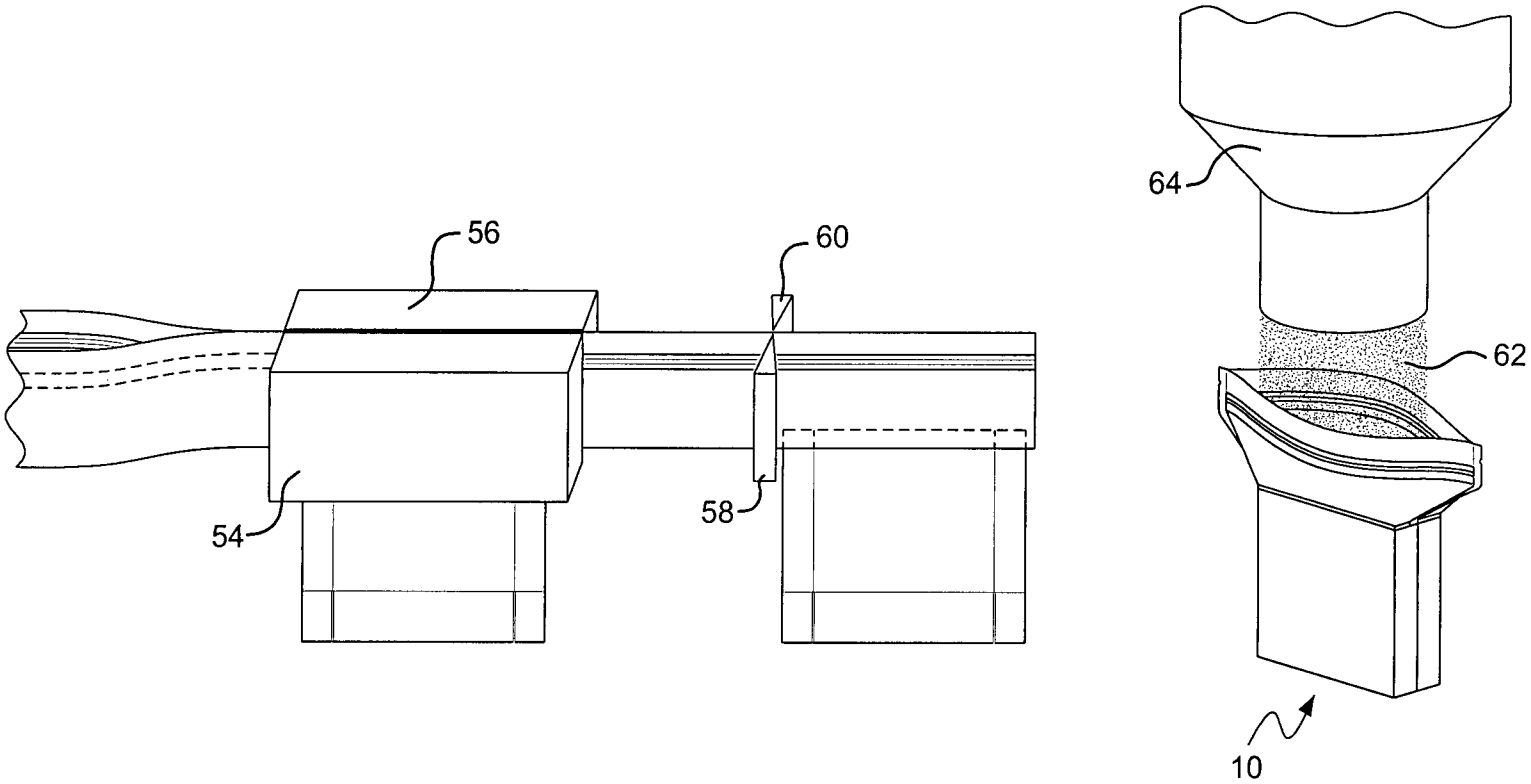

FIGS. 6 and 7 schematically illustrate one process for producing the combined box and resealable bag 10 of the present invention. As shown in FIG. 6, two rolls 44 and 46 of suitable plastic film material are arranged so that the plastic unrolled therefrom can form the front and rear walls of a bag 14. Male and female components 48 and 50 of the zipper 16 are arranged and properly oriented and parallel with the plastic film. A box blank such as shown at 52 with the upper ends folded downwardly to form the upwardly facing attachment strips 32 and 34 is then moved into position at the lower edge of the bag forming plastic film material 44 and 46.

With the plastic film 44 and 46 and the box blank 52 properly positioned with respect to each other, a pair of opposed heat sealing dies 54 and 56 are then brought together to heat seal the zipper components 48 and 50 to the plastic film 44 and 46. Simultaneously, the dies heat seal the lower portion of the bag forming plastic film 44 and 46 to the thermoplastic coating on the strips 32 and 34 of the box blank 52.

As shown in FIG. 7, after the dies 54 and 56 have heat sealed the components together, knife blades 58 and 60 cut the sides of the plastic film material to form the bag. Thereafter, the box blank is expanded as pointed out above and filled with material 62 that is fed through the hopper 64.

The present invention may be embodied in other specific forms without departing from the spirit or essential attributes thereof and accordingly, reference should be made to the appended claims rather than to the foregoing specification as indicating the scope of the invention.

We claim:

1. A method of forming a combined box and resealable bag comprising the steps of:

providing a paperboard box blank having a front wall, a rear wall, a pair of opposed side walls and a plurality of folded portions capable of forming a bottom wall and wherein said front, rear and side walls have upper ends and lower ends and inside surfaces and outside surfaces;

providing a plastic bag portion having a recloseable zipper top and downwardly extending front and rear walls, said front wall having a lower edge having an inside surface and an outside surface, said rear wall having a lower edge having an inside surface and an outside surface;

sealing said inside surface of said lower edge of said bag front wall to said outside of said upper end portion of said paperboard box blank front wall while said blank is in a flat planar condition; and sealing said inside surface of said lower edge of said bag rear wall to said outside of the upper end portion of said paperboard box blank rear wall while said blank is in a flat planar condition.

2. The method of forming a combined box and resealable bag as claimed in claim 1 further comprising the step of folding outwardly and downwardly the-upper end of each of said front, rear and side walls of said box blank so that the inside surface of each of the upper ends forms a strip that faces outwardly and lies in substantially the same plane as its respective outer surface.

3. The method of forming a combined box and resealable bag as claimed in claim 2 further including the step of securing the resultant folded strips which face outwardly and lie in the substantially the same plane as the respective outer surfaces of the box blank.

4. The method of forming a combined box and resealable bag as claimed in claim 2 wherein said inside lower edges of said bag front and rear walls are sealed to said strips.

5. The method of forming a combined box and resealable bag as claimed in claim 4 wherein said inside surfaces of said box walls, including said outwardly facing strips, have a thermal plastic coating thereon.

6. The method of forming a combined box and resealable bag as claimed in claim 5. wherein said lower edge of said bag front and rear walls are heat sealed to said strips.

7. The method of claim 1 comprising coating the outside of the box with a thermoplastic coating.

8. The method of claim 1 comprising gluing a strip to an outer surface of a wall.

9. The method of claim 1 comprising folding and sealing the bottom of the container, opening the zipper, and filling the container through the opened zipper.

10. The method of claim 1 comprising expanding said front, rear and side walls of said box blank to form a box.

11. The method of claim 1 wherein the each of the two side walls of said box blank comprises a vertical fold line at its mid-point and the method comprises expanding said front, rear and side walls of said box blank while unfolding the fold lines of the side walls to form a box.

12. The method of claim 1 comprising heat sealing the bag front and rear walls together.

* * * * *